US006669200B1

(12) United States Patent
Knetsch et al.

(10) Patent No.: US 6,669,200 B1
(45) Date of Patent: Dec. 30, 2003

(54) DISC TOSS GAME

(76) Inventors: William Ray Knetsch, 6622 Flounder Ct., Farmington, MN (US) 55024; Dennis Kent Gustafson, 6618 Flounder Ct., Farmington, MN (US) 55024; Thomas James Gustafson, 9858 - 206$^{th}$ St., W., Lakeville, MN (US) 55044

( * ) Notice: Subject to any disclaimer, the term of this patent is extended or adjusted under 35 U.S.C. 154(b) by 0 days.

(21) Appl. No.: 10/289,792

(22) Filed: Nov. 7, 2002

Related U.S. Application Data

(63) Continuation-in-part of application No. 09/851,048, filed on May 8, 2001, now abandoned.
(60) Provisional application No. 60/202,965, filed on May 10, 2000.

(51) Int. Cl.$^{7}$ ..... A63B 63/04
(52) U.S. Cl. ..... 273/400
(58) Field of Search ..... 273/398–402

(56) References Cited

U.S. PATENT DOCUMENTS

| | | | | | |
|---|---|---|---|---|---|
| 979,109 | A | * | 12/1910 | Underhill | 273/400 |
| 3,351,344 | A | * | 11/1967 | Dupuy | 273/400 |
| 4,392,653 | A | * | 7/1983 | Blume, Sr. | 273/400 |
| 4,877,256 | A | * | 10/1989 | Falloon | 273/400 |
| 4,982,966 | A | * | 1/1991 | Teafatiller | 273/338 |
| 4,989,880 | A | * | 2/1991 | Gettemeier et al. | 273/336 |
| 5,018,745 | A | * | 5/1991 | Dunse | 273/338 |
| 5,110,139 | A | * | 5/1992 | Baumgartner | 273/400 |
| 5,139,272 | A | | 8/1992 | Villafuerte | |
| 5,282,635 | A | * | 2/1994 | Hopkins | 273/342 |
| 5,316,310 | A | | 5/1994 | Nicholas, Sr. et al. | |
| 5,382,028 | A | | 1/1995 | Sciandra et al. | |
| 5,419,566 | A | | 5/1995 | Byrd | |
| 5,553,862 | A | * | 9/1996 | Konotopsky | 273/402 |
| 5,882,010 | A | | 3/1999 | Geror | |
| 2002/0175469 | A1 | * | 11/2002 | Kessler et al. | 273/400 |

* cited by examiner

*Primary Examiner*—Mark S. Graham
(74) *Attorney, Agent, or Firm*—Haugen Law Firm PLLP

(57) ABSTRACT

A disc toss game which includes a target box or receiver with a false bottom interposed between the top and bottom edges, with the elevation of the false bottom being positionably adjustable relative to the plane of the top edges of the target box. A standpipe or tube is mounted within the target box coaxially with the center of the square target box. The target box has an outer perimeter defined by chamfered edges, with the plane of the top edge of the open standpipe or tube being positionably adjustable within the target box from an upper position which is coplanar with the edges of the target box, into one or more lower positions in which the top edge of the standpipe is recessed from the plane of the top edges of the target box.

3 Claims, 3 Drawing Sheets

SUGGESTED SPACING BETWEEN CUBES

DISC TOSS GAME

CROSS-REFERENCE TO RELATED APPLICATION

The present application is a continuation-in-part of our utility patent application Ser. No. 09/851,048, filed May 8, 2001, entitled "DISC TOSS GAME," which was based upon Provisional Application Serial No. 60/202,965, filed May 10, 2000, and entitled "DISC TOSS GAME".

BACKGROUND OF THE INVENTION

The present invention relates generally to an improved disc-toss game assembly which incorporates a receiver with an open top disc-receiving target surface comprising an upright tubular member or standpipe positioned centrally within an elevated height adjustable false bottom. The object of the game is for the individual participants to stand at a predetermined distance from the target box or receiver and then throw and/or toss the individual discs toward the target, with the primary objective being to have the disc enter the open top of the tubular target, and with the secondary objective being to have the disc remain within the confines of the walls of the target box.

The tubular member extends vertically upward from a positionably adjustable intermediate supporting surface or false bottom in the receiver, the surface being adapted to receive or otherwise retain those discs which are tossed and come close but fail to enter the tubular target. In other words, they are nevertheless sufficiently close to be within the area of the intermediate surface. The bottom of the receiver tube is normally cylindrical but may be frusto-conical in configuration and dimensioned so that individual receivers may be stacked, one upon the other. The configuration of the receiver box as well as the configuration of the receiver tube may be configured and dimensioned to accommodate telescopic stacking.

In the past, various disc-toss games have been proposed and utilized. As employed herein, the term "disc " is used in a comprehensive sense, and is intended to include both disc-shaped objects as well as toroidal configured objects. The individual discs are typically solid plastic and may be covered with a soft, resilient coating in order to permit convenient handling as well as to avoid the use of edged objects which are tossed. Such discs and rings have been resiliently covered and employed in games in the past.

Ring-toss games have been proposed wherein the disc receiving standpipe is positioned with an axis angularly disposed relative to the vertical axis. The present arrangement provides significant advantages to enhance the play of the disc-toss game as well as to provide significant advantages in stacking and storing those individual components which comprise the game. A further advantageous feature of the present invention which enhances the play of the game by providing a variable range of difficulty is the utilization of a positionably adjustable support for both the standpipe and false bottom in the receiver. By way of explanation, the standpipe is mounted centrally of the false bottom, and its upper edge surface provides an opening into which the discs are tossed, with the elevation of this opening being adjustable to vary the degree of difficulty of the game. Essentially, the elevation of the opening may be at the same level as the surrounding wall, or alternatively may be conveniently positioned at a lower elevation so as to provide a lesser degree of difficulty for the player in having the disc actually enter the top of the standpipe.

SUMMARY OF THE INVENTION

In accordance with the present invention, a disc-toss game utilizes receivers with an adjustably positioned false bottom which includes a vertical upright standpipe target with an open disc or ring receiving top. Additionally, the receiver utilizes a positionably adjustable intermediate supporting surface through which the conical-tubular target or standpipe extends. This surface or false bottom is adapted to receive and hold those discs which are tossed and drop close to the open-top target, but which fail to enter the target pipe. In order to provide greater convenience in storing the game device when not in use, the entire receiver assembly may be arranged to be telescopically stackable, thereby reducing the area and volume required for storage.

Therefore, it is the primary object of the present invention to provide an improved disc-toss game arrangement, which includes the feature of receivers having a positionably adjustable false bottom with a vertically disposed standpipe target mounted within the assembly.

It is a further object of the present invention to provide an improved disc-toss game arrangement which includes a plurality of receiver assemblies, each being provided with a vertically disposed open-top standpipe to function as a receiver and target receiver for the discs being tossed by the game participants, and with a positionably adjustable false bottom for retaining discs which actually enter the receiver but fail to enter the open top standpipe.

Other and further objects of the present invention will become apparent to those skilled in the art upon a review of the accompanying specification and drawings.

IN THE DRAWINGS

FIG. 3 is a top plan view of the receiver assembly; and.

DESCRIPTION OF THE PREFERRED EMBODIMENT

Figure 1:
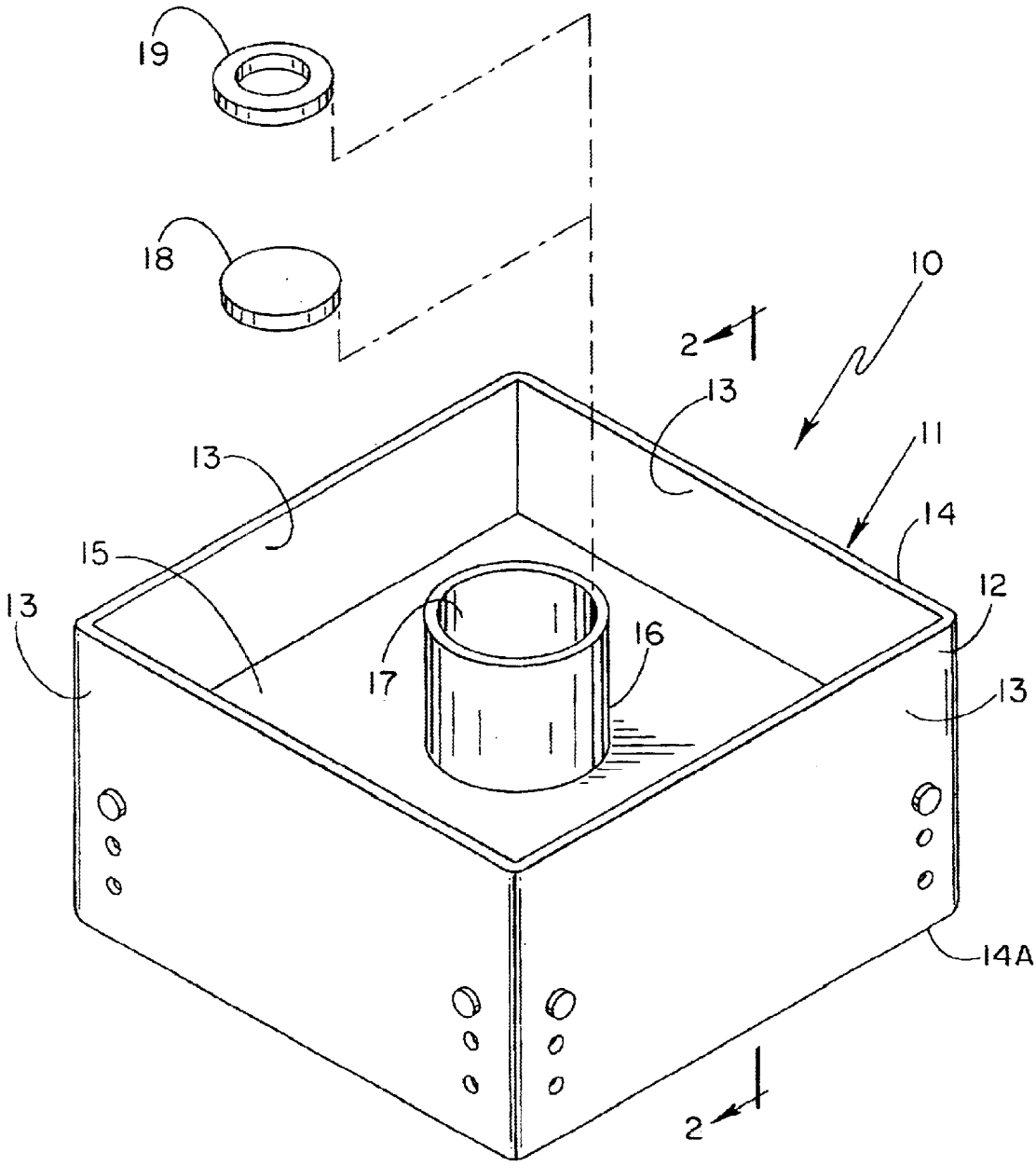
FIG. 1 is a perspective view of a preferred embodiment of a stackable telescoping receiver assembly, and showing the open-top standpipe receiver protruding along a vertical axis and showing an exploded view, a typical ring and/or disc used by the participants.
Figure 2:
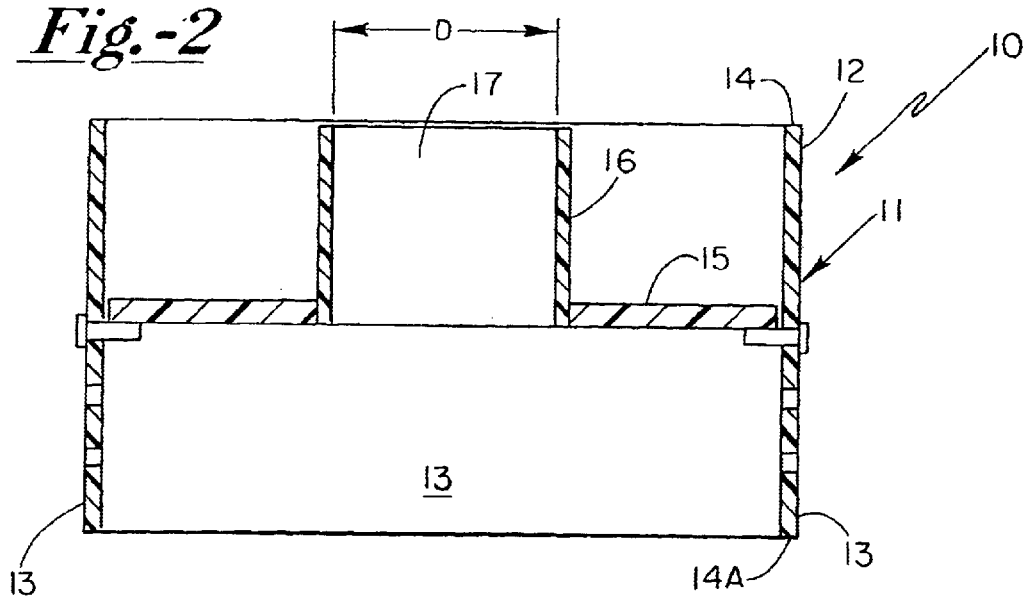
FIG. 2 is a vertical, sectional view taken along the line and in the direction of the arrows 2—2 of FIG. 1.
Figure 3:
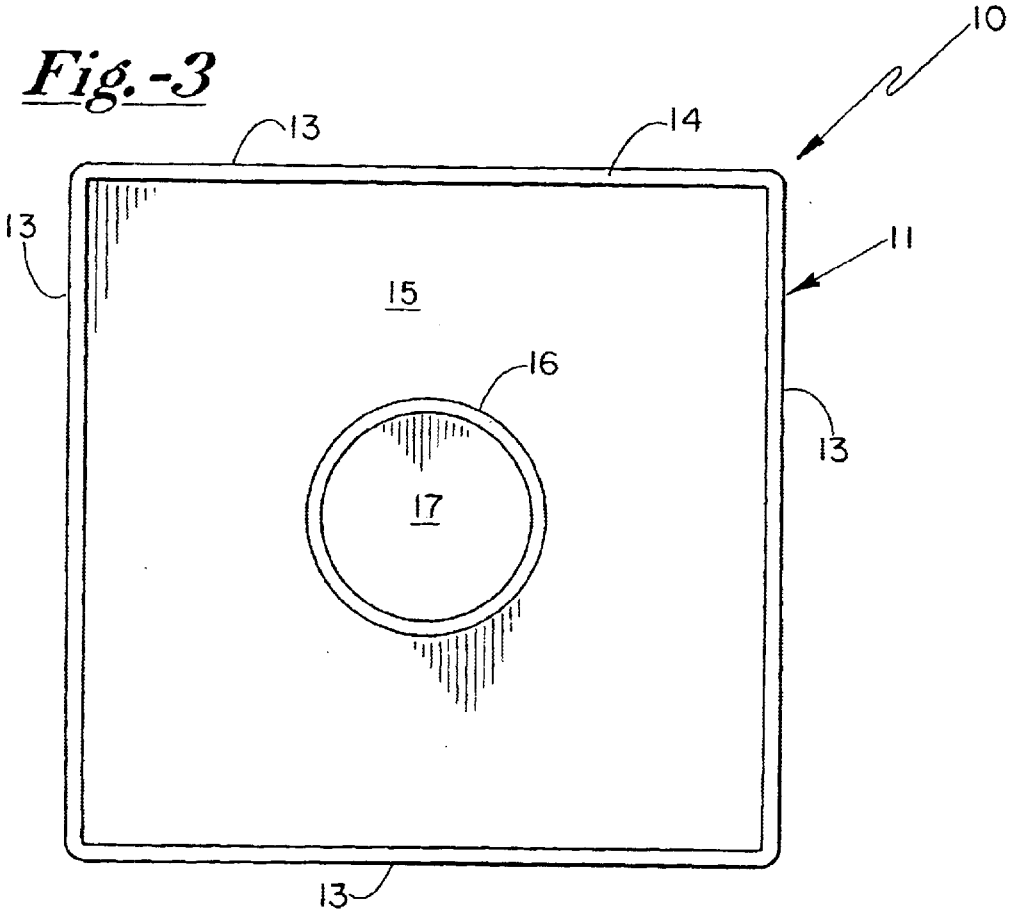

In accordance with the preferred embodiment of the present invention, and with particular attention being directed to FIG. 1, the receiver box or assembly generally designated 10, comprises a generally square tube in the form of a modified receiver cube member 11 having an open upper edge 12 along with lower wall portions 13—13 of rectangular configuration, and an axis extending therebetween. A positionably adjustable intermediately disposed false bottom or support 15 is provided through which extends a target standpipe 16, this being a tubular member with an open top as at 17 and a vertical axis extending therethrough. Two individual disc designs are shown in exploded disposition such as at 18 and 19, with these discs being suitable alternatives for use as ring or disc toss members. Preferably, discs 18 and/or 19 of solid plastic and may be coated with a suitable resilient coating such as a silicone rubber, durable and rigid plastisol, or the like. The outer peripheral circular edges are preferably chamfered so as to facilitate entry into the opening 17 and to reduce the presence of sharp edges. The individual discs may be in either a planar or disc form such as disc 18 or alternatively in toroidal form such as member 19. It has been determined through testing that the diameter of the disc members 18 or 19 is preferably two-thirds of that of the diameter of the opening "D" of standpipe 16. By way of specific example, opening 17 preferably has a diameter of three inches, while the diameter "D" of the discs 18 or 19 is two inches. Also, suitable lateral dimensions for the interior of receiver 10 is 9 inches for use in combination with the standpipe described above. With continued attention being directed to FIGS. 1 and 2, it will be noted that the upper edge of square or cube member 11 has upper and lower annular peripheral edges 14 and 14A, with upper edge 14 being shown in a coplanar relationship with the upper edge 17 of standpipe 16. As indicated in FIGS. 1 and 2, means are provided to positionably adjust the elevation of support 15 and accordingly standpipe 16, so as to permit the open top of standpipe 16 to be positioned in recessed relationship relative to the plane of upper edge 14. This feature provides an advantage in modifying the degree of difficulty, thus challenging the skill level of the individual players. An errant disc striking edge 14 is less likely to fall within the confines of the standpipe, and therefore drop onto the surface of support 15. In order to assist players in improving their level skill, the outer surface of target standpipe 16 is preferably made in a color which contrasts with that of receiver cube member 11.

With attention now being directed to FIG. 2 of the drawings, the configuration of member 11 may be made in the form of a truncated pyramid such that the lateral dimensions of the outer shell or shroud of receiver 11 converge toward the top, and therefore are greater at the base than at the top. The base portion of such a receiver will telescopically engage the top portion 12 of a second receiver, with the expanded dimension being sufficient to permit stacking. In addition, the configuration of standpipe 16 may be conical, so as to enclose and telescopically mate with another. Also, suitable hand-gripping openings may be provided.

Figure 4:
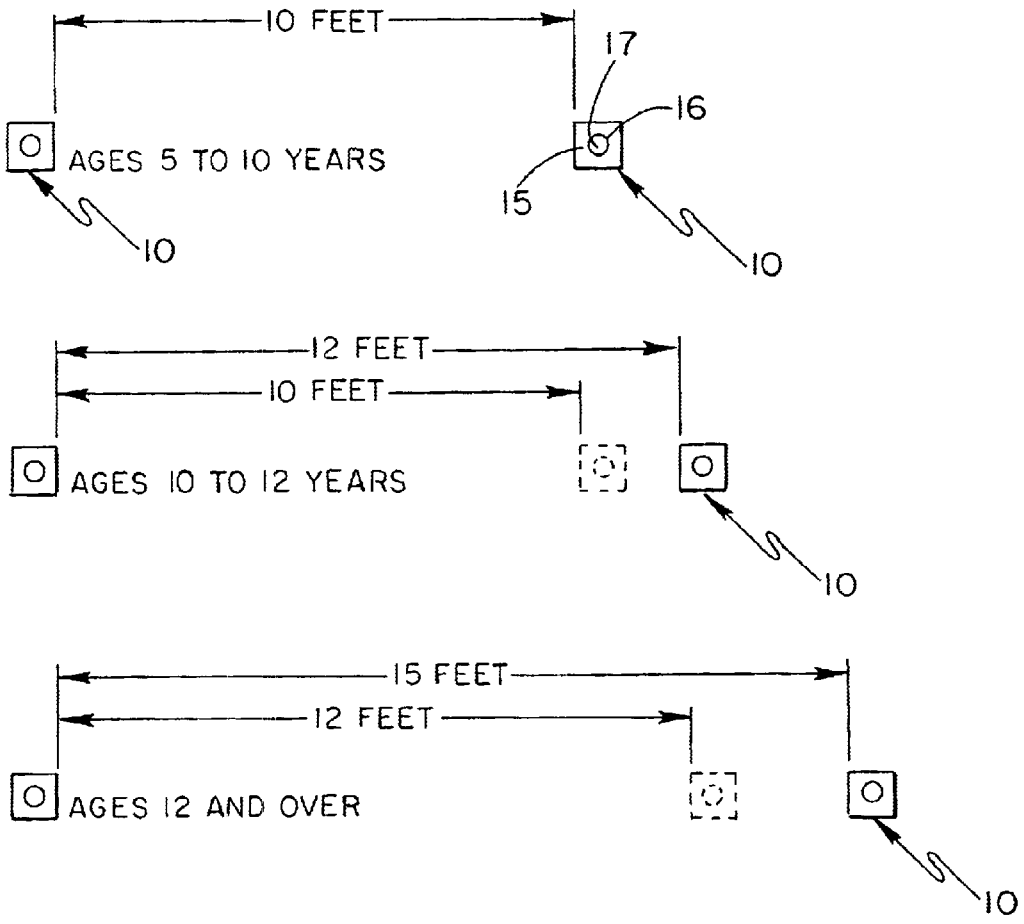
FIG. 4 is a chart illustrating the suggested spacing between individual, cubical receiver cubes and individuals falling within various age groups.

With attention now being directed to FIG. 4 of the drawings, recommended spacing between individuals and targets are arranged with reference to the age of the participants. For those of the ages between 5 and 10 years, a spacing of 10 feet has been recommended and has been found suitable and manageable for the enjoyment of such participants. Also, for such an age group, it is preferable that the top of the standpipe be one-half inch below the top edge surfaces of the receiver box. Such spacing, and positioning of the standpipe provides an opportunity for both a challenge and a reward for the participants. As indicated, the individual participants will stand at the distance from the target cube, and then toss the disc from the standing position toward and into the target. Those discs, which are accurately tossed, will enter the opening 17 of vertical standpipe 16, and will provide a predetermined count or score for the participant. Also, for those discs which fail to enter the opening 17, but nevertheless are sufficiently close to be retained on intermediate support surface 15 will provide a lesser point score for the participant tossing the disc.

The false bottom may be held in place by suitable fasteners, such as by slidable fasteners which are inserted and removed by finger pressure. In this connection, canoe-type fasteners or tubular fasteners with spring-biased radially extending spherical stops may be employed. Also, if desired, typical wood screws or the like also provide a satisfactory means for adjustably positioning the false bottom. Any of these fasteners may extend inwardly to support the false bottom along its underside surface, or alternatively, mating bores may be formed inwardly from the outer edges of support 15 to receive the supporting removable rod-like members.

In the following Table I, typical and/or representative dimensions for a generally universally utilized system are given.

TABLE I-A

| Component | Recommended Dimensions |
|---|---|
| Square target box receiver | 9" (inner dimension) 5.5" (height dimension); |
| Standpipe | 3" I.D. |
| Disc | .5" × 2" diameter. |

TABLE I-B
Elevation of Tube Mouth:

| Participant | Elevation Relative to Outer Walls |
|---|---|
| Beginner | 1" recess |
| Intermediate | .5" recess |
| Advanced | flush. |

In some instances, it may be desirable to utilize different dimensional recesses, with recess dimensions of one-quarter inch and one-half inch for intermediate and beginner participants, respectively, having been found to be useful.

As indicated above, the discs are preferably coated with resilient coating, and this coating may be color-coded in order to enable the participants to more readily identify the participants responsible for tossing of the individual discs.

Various modifications may be made in the configuration of the arrangement illustrated here without departing from the invention.

What is claimed is:

1. A disc toss game comprising, in combination, a generally square target box having four walls with inner and outer surfaces and with each wall having top and bottom edges, and having a positionably adjustable false bottom interposed between said top and bottom edges, a standpipe disposed within said target box and being mounted within said false bottom and positioned coaxially with the interior of said target box, and further including at least one hand-tossed disc having an outer perimeter defined by chamfered edges, the combination being characterized in that:

(a) said generally square target box having an axis extending between said top and bottom edges;

(b) said standpipe having a disc receiving open mouth formed within the inner diameter thereof, with said upper edge surface of said disc receiving open mouth being positionably adjustable relative to said target box top edges; and (c) wherein said walls have bores formed therein at predetermined elevations relative to said top wall edges for receiving elongated false bottom supporting support means for positionably adjusting the height of said disc-receiving open mouth relative to said target box top edges.

2. The combination of claim 1 wherein the diameter of said toss disc is substantially two-thirds of the diameter of said disc receiving mouth.

3. The combination of claim 1 wherein more than two vertically spaced apart bores are formed in each of said four walls in vertically spaced apart relationship, one to another to provide access to said false bottom support means for adjustably positioning said disc-receiving open mouth.

* * * * *